US006804976B1

(12) United States Patent
Dain

(10) Patent No.: US 6,804,976 B1
(45) Date of Patent: Oct. 19, 2004

(54) HIGH RELIABILITY MULTI-TUBE THERMAL EXCHANGE STRUCTURE

(76) Inventor: John F. Dain, P.O. Box 1418, Hollister, CA (US) 95024

( * ) Notice: Subject to any disclaimer, the term of this patent is extended or adjusted under 35 U.S.C. 154(b) by 0 days.

(21) Appl. No.: 10/734,509

(22) Filed: Dec. 12, 2003

(51) Int. Cl.[7] ..... F25B 39/02; F28F 1/32; F28F 1/10; F28F 9/02

(52) U.S. Cl. ..... 62/525; 62/524; 62/504; 62/515; 165/174; 165/171; 165/172; 165/173; 165/148

(58) Field of Search ..... 62/525, 524, 504, 62/515, 117, 290; 165/171–174, 151, 148; 122/155.4, 240.3, 285, 235.34, 296

(56) References Cited

U.S. PATENT DOCUMENTS 3,601,186 A * 8/1971 Smith et al. ..... 165/176
4,040,268 A * 8/1977 Howard ..... 62/335
5,353,749 A * 10/1994 Seibel et al. ..... 122/240.1
5,440,894 A * 8/1995 Schaeffer et al. ..... 62/203
5,743,111 A * 4/1998 Sasaki et al. ..... 62/511
5,884,696 A * 3/1999 Loup ..... 165/140
5,910,167 A * 6/1999 Reinke et al. ..... 62/525
5,947,195 A * 9/1999 Sasaki ..... 165/173
6,185,957 B1 * 2/2001 Voss et al. ..... 62/513
6,390,187 B1 * 5/2002 Marechal et al. ..... 165/172
6,490,877 B2 * 12/2002 Bash et al. ..... 62/200
6,543,240 B2 * 4/2003 Grafton ..... 62/214
6,606,882 B1 * 8/2003 Gupte ..... 62/504

* cited by examiner

*Primary Examiner*—Denise L. Esquivel
*Assistant Examiner*—Filip Zec
(74) *Attorney, Agent, or Firm*—J. E. McTaggart

(57) ABSTRACT

For high reliability through redundancy, in a thermal chamber, heat exchange tubes are configured in multiple parallel runs. Typically three tubes are attached side-by-side in a strip which is formed into folded-back horizontal rows to be built into or attached to the walls of the chamber. In a freezer, each tube can serve independently as an evaporator when connected to a compressor/condenser source. Versatile source interfacing is provided by two valve-manifold routing units, one at each end of the multi-tube strip, enabling easy tube substitution in case of failure, as well as facilitating source-swapping, networking, defrosting and refrigerant operations such as purging, flushing, replenishing, changing or replacement, all without interrupting the required cooling process or affecting the chamber temperature. The multi-tube strip and valve-manifolds enhance the reliability of thermal systems such as ultra-low temperature biomedical freezers entrusted with critical at-risk payloads, and assist owner-operators in maintaining such systems fully operational with minimal need for outside repair expertise.

10 Claims, 3 Drawing Sheets

HIGH RELIABILITY MULTI-TUBE THERMAL EXCHANGE STRUCTURE

FIELD OF THE INVENTION

The present invention relates to the field of heat energy exchange apparatus including thermal chambers and caloric sources thereof including refrigeration, and is more particularly directed to thermal chambers with high reliability obtained by providing flow path redundance in the thermal exchange structure and versatile control of associated flow rerouting, e.g. in the evaporator tubes and associated source interconnections of an ultra-low-temperature freezer for storing critical temperature-sensitive and/or potentially harmful substances in facilities such as biomedical laboratories where high reliability is essential.

BACKGROUND OF THE INVENTION

There is an increasing demand in the field of the invention for ultra high reliability thermal apparatus, especially ultra-low-temperature freezers used for storing biomedical substances. A refrigeration failure in the commercial food field can be costly in terms of food spoilage and business disruption. However such failure could be catastrophic in the biomedical field; for example if it involved a limited supply of special vaccine, stored for emergency protection of the general public, lack of immediate repair or refrigerated transportation to another site of a cooling chamber facility pending corrective action could result in a disastrous total loss of the vaccine. Refrigeration failure involving toxic substances can cause personal damage and/or set off alarms that require immediate and total building evacuation. On-site personnel rarely have the expertise to take the corrective action, so there is a critical dependancy on prompt expert response in such failures.

The functional process of cooling in refrigeration takes place in the evaporator, which is typically implemented as tubing built into the walls of the low-temperature chamber. Refrigerant entering the evaporator in liquid state at an end of the tubing "boils" or evaporates, changing state from liquid to gas, thus consuming heat energy and producing the cooling effect. The gas is drawn out from the opposite end of the tubing, recompressed and condensed back to liquid state in a continuous loop process.

In a common evaporator failure mode, experienced frequently in automotive air-conditioners, heaters and radiators, a pinhole leak in the tubing itself, or at a fitting, causes loss of refrigerant or other fluid medium and this cumulative loss soon degrades the thermal process and leads ultimately to total failure, meanwhile possibly contributing to pollution from the escaping gas: in the automotive case, environmental air pollution, and/or, as in the cooling chamber case, exposing the valuable payload of critical protected substances to possible contamination.

The term "chamber" in the present disclosure is intended to mean any thermal chamber, ranging from ultra-low temperature freezers to warming/heating chambers, in which typically it is desired to maintain substantially constant internal temperature, independent of ambient temperature and variations thereof, by circulation of a fluid thermal agent through a heat-exchanger, typically tubing located in or near the walls of the chamber

DISCUSSION OF KNOWN ART

It has been known to seek improved reliability in a heat exchange type structure such as an evaporator by providing redundancy in the form of a secondary backup unit or element that can be substituted to operate in place of the primary unit or element.

Permanently connecting multiple runs of tubing in parallel, as practiced commonly in automobile radiators, heaters and air conditioners and the like, increases the cross-sectional area and thus reduces the probability of flow restriction, however the risk of developing leakage increases with multiplicity, reducing the overall reliability.

U.S. Pat. No. 5,440,894 to Schaeffer et al for STRATEGIC MODULAR COMMERCIAL REFRIGERATION discloses a commercial refrigeration network with a plurality of multiplexed compressors, condenser and associated high side and low side refrigerant delivery and suction conduits and including a remote cooling source.

U.S. Pat. No. 6,490,877 to Bash et al for MULTI-LOAD REFRIGERATION SYSTEM WITH MULTIPLE PARALLEL EVAPORATORS discloses the principle of independently metering the flow of refrigerant into each of a plurality of evaporators for the purpose of maintaining constant temperature despite heat load fluctuations.

U.S. Pat. No. 5,947,195 to Sasaki for MULTI-TUBE HEAT EXCHANGER AND AIR CONDITIONER HAVING THE SAME discloses a multi-tube heat exchanger including a pair of tanks and a large plurality of heat transfer tubes fluidly interconnected between the tanks for reducing the size of the heat exchanger and the associated air conditioner for vehicles, with air flow directed in either direction between a single duct and a plurality of branched ducts.

OBJECTS OF THE INVENTION

It is a primary object of the present invention to provide increased reliability in a thermal exchange structure such as a refrigeration evaporator in an ultra-low-temperature chamber of the type used for storing and preserving biomedical substances.

It is a further object to attain high reliability by providing redundancy and ease of substitution in the tubing structure of an evaporator in the event of leakage.

It is a further object to provide flexibility in deployment of redundant tubing sections in the evaporator to offer alternative configurations to satisfy differing needs and situations.

It is a further object to provide interface hardware units structured to facilitate manual and automatic redirection of refrigerant to redundant sections in the evaporator as well as capability of source-swapping, thus providing high system reliability through total redundancy that can be readily deployed by non-expert owner-operators without disruption or impairment of system operation.

SUMMARY OF THE INVENTION

The foregoing objects have been met in the invention of a thermal tubing structure that provides a thermal exchange system, such as an evaporator, with multi-tube redundancy for high reliability in a thermal chamber such as a freezer.

A cluster of parallel multiple continuous-length tubing runs, typically three tubes attached side-by-side, is formed in a manner to be built into the walls of the chamber or attached to a false plenum lining the inside walls of the chamber. The tube ends are fitted with a pair of versatile valve-manifold units, one at each end, that provide versatility for interconnecting to the associated thermal source(s) such as a compressor/condenser unit, with capability of rapid automatic rerouting to another tube in case of failure of any one of the tubes.

For ultra-low-temperature freezers such as those for storing bio-medical materials, the multi-tube evaporator of the present invention facilitates operations such as defrosting and refrigerant operations such as purging and replacing refrigerant, or flushing with a cleansing fluid without interrupting the required cooling process.

The multi-tube evaporator and valve-manifold system enhances ultimate reliability for low temperature systems entrusted with critical at-risk payloads, and enhances an inexpert owner-operators capability of keeping such systems operating within specification with a minimum of requirement for outside expert assistance, thus avoiding the costs, uncertainties and other disadvantages of reliance on outside experts.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
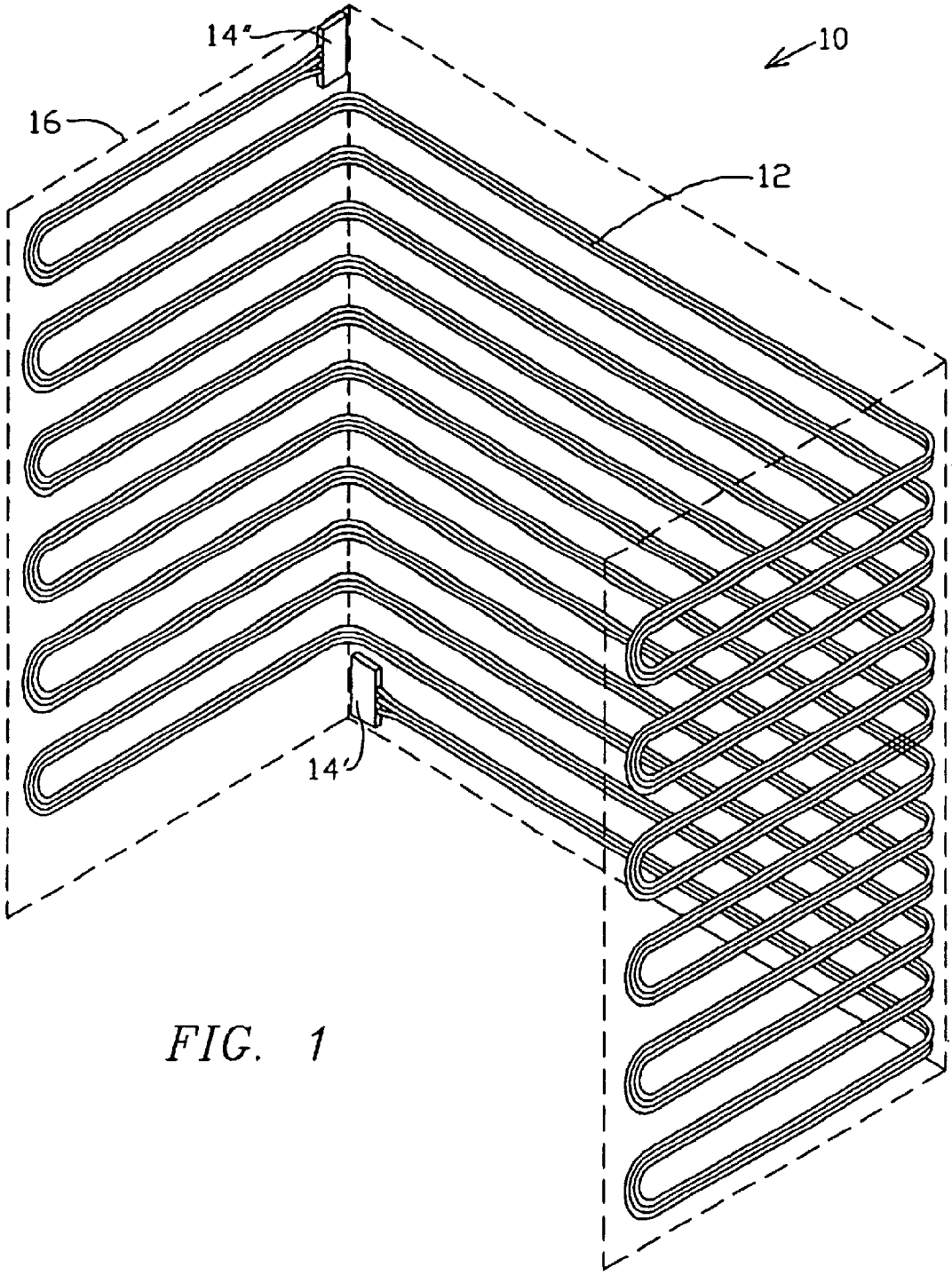
FIG. 1 is an isometric representation of a triple-tube thermal exchange system of the present invention, in an illustrative embodiment thereof, deployed in a thermal chamber.

FIG. 1 is an isometric representation of a thermal tubing structure 10 representing an illustrative embodiment of the present invention that can serve as the heat exchange element in a temperature chamber, e.g. the evaporator in the refrigeration system of an ultra-low-temperature freezer of a type utilized for bio-medical material storage.

A multi-tube strip 12, in this example made from three tubes attached in parallel in a vertical row, is configured to extend in horizontal rows with U-shaped end-returns, as shown, extending around three sides of a chamber 14 whose outline is indicated in dashed lines.

In a typical original system installation, strip 12 would be built into the hollow walls of thermal chamber 14 and backed with thermal-insulation around the outside of strip 12.

Alternatively, a thermal exchange unit of the present invention can be installed around the inside walls of a pre-existing thermal chamber, supported in place by a plenum structure, to function in cooperation with, or in place of, an existing built-in thermal exchange (e.g. evaporator) unit.

Strip 12 is typically fabricated by pre-forming the individual tubes to the required size and shape, and then fastening them together at selected intervals, e.g. by soldering, welding, brazing, strapping, adhesives and/or other fastenings. The tubing can be of selected metal such as stainless steel or copper.

As an alternative to pre-forming the tubes individually in a three-dimensional pattern they could be pre-attached together into a continuous two dimensional ribbon strip that can be stocked and transported in a large long roll, then later cut to total lengths and formed as required in rows for different sized chambers. For three-dimensional forming, the pre-attached ribbon strip could be readily bent as shown in FIG. 1 at the rear corners of chamber 16, however at the front edges, due to the length variations resulting from the three different radii involved in the flat one-dimensional U-shaped bends as shown, the ribbon strip would have to be reshaped with a 180 degree twist or other viable three-dimensional reformation in the region of each of the U-shaped bends in order to accommodate the uniform tubing lengths in the pre-attached ribbon strip.

The three tubes making up strip 12 are connected at their respective ends to valve-manifolds 14' and 14", one at each end of strip 12 as shown, serving as versatile network distribution routers and shut-off interrupters which are in turn typically connected via external low and high pressure lines to at least one refrigeration source which typically includes a compressor and condenser unit that converts gas from the upper end of strip 12 of the evaporator back to liquid state for recirculation into the lower end of strip 12 in a loop process. This source unit can be remotely located.

Figure 2:
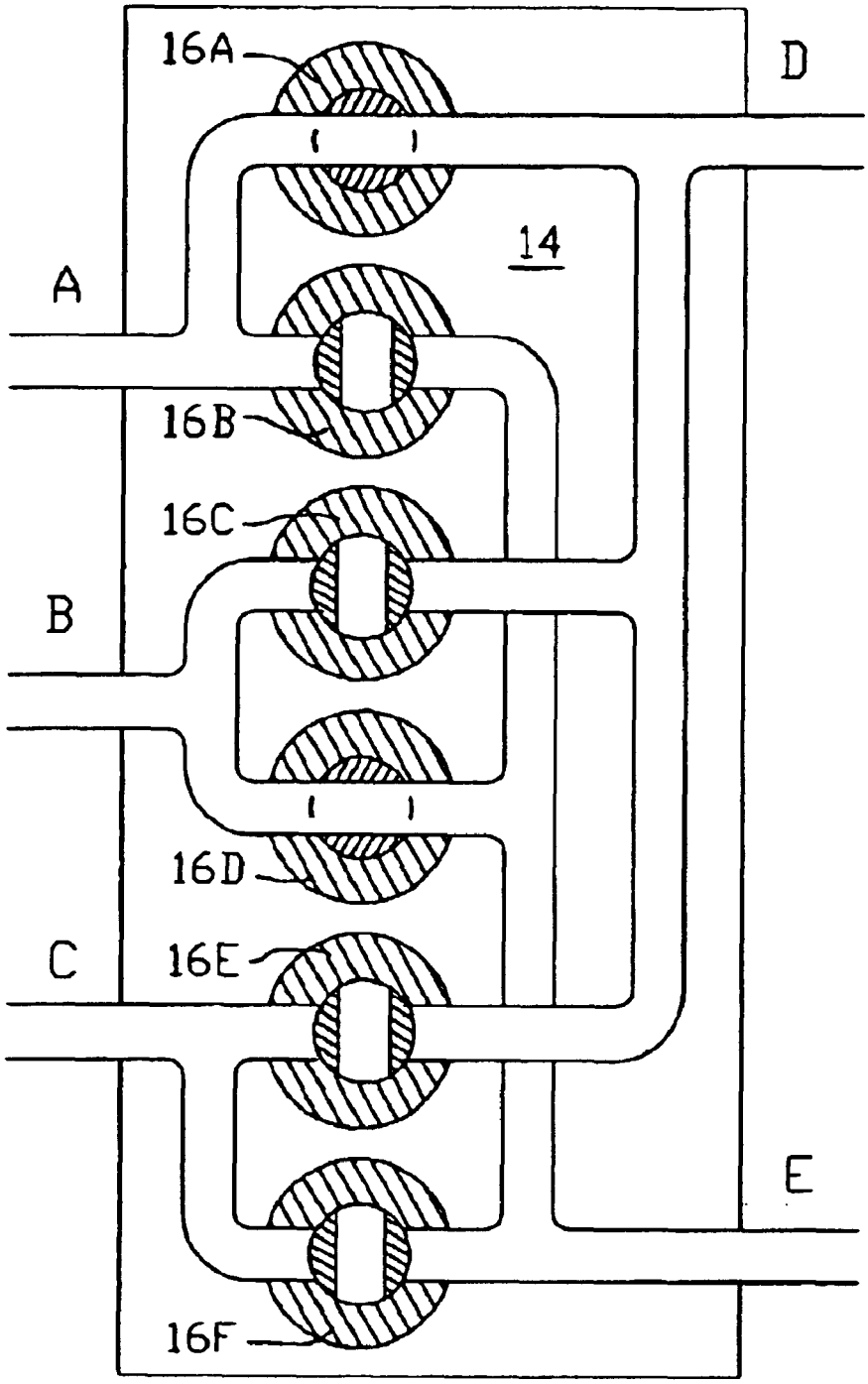
FIG. 2 is a functional diagram of a valve-manifold unit of the thermal exchange system of FIG. 1.

FIG. 2 is a functional diagram of a valve-manifold 14, typical of either one of the two identical valve-manifolds 14' and 14" shown in FIG. 1, which are connected one at each of the two opposite ends of strip 12.

Valve-manifold 14 is configured with 5 ports: tube ports A, B and C, for connection to ends of the corresponding three tubes in strip 12, and tube ports E and E, which are source ports. At least one of these source ports in each valve-manifold (14' and 14" FIG. 1) is to be connected to a corresponding source line, e.g. one to the low pressure/suction compressor intake and the other from the pressure condenser output of the primary refrigeration source unit. The other source ports, one in each valve-manifold 14, being available for connection to a secondary source, other special function, or simply held in reserve as a standby.

The six valves 16A–16F each provide an on/off (open/closed) function that can be implemented with a rotating ball or cylinder core in well-known fluid valve structure. They could be of a basic manually-operated type, however for automatic control and networking, such valves are available equipped with electrical, hydraulic or pneumatic actuators. As a matter of design choice in the control system, automatic operation could be allowed to override manual settings, or manual settings could be allowed to override the automatic operation.

Valves 16A and 16D are shown set to their on (open) state; valve 16 places the active tube port A in fluid communication with its source port D, and valve 16D places tube port B in fluid communication with source port E, available for a variety of auxiliary functions such as connection to a secondary source unit.

Valve-manifold 14, representing the two identical valve-manifolds 14' and 14", can be custom manufactured as a solid or laminated metal block machined to provide the necessary passageways and valve cavities with suitable valve cores inserted accordingly; alternatively valve-manifold 14 can be fabricated utilizing commercially available valves interconnected by tubing or pipe in a known manner.

Figure 3:
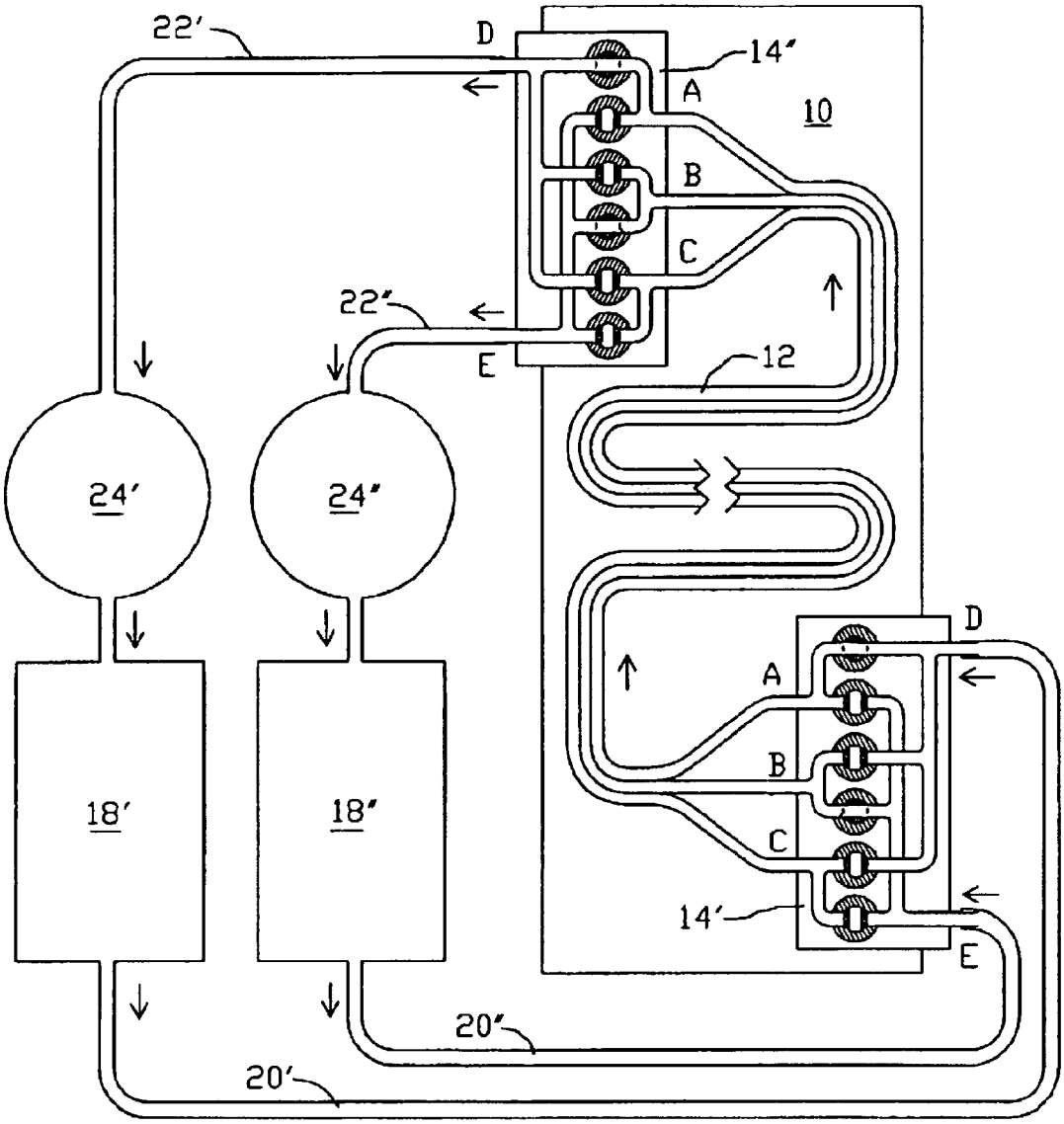
FIG. 3 is a functional block diagram showing a thermal exchange system of the present invention as in FIG. 1 with the triple-tube strip deployed as an evaporator along with a pair of valve-manifolds set as in FIG. 2, in a dual-redundancy refrigeration system.

FIG. 3 is a functional block diagram showing a triple-tube thermal exchanger 10 the present invention as in FIG. 1, deployed as the evaporator in a refrigeration system that benefits from the high reliability accomplished by independent triple-tube redundancy along with independent dual-source redundancy. A primary and a secondary system each utilize a corresponding single tube of the triple-tube strip 12, leaving the third tube as a backup substitute evaporator available to either system in the event of an evaporator failure.

The valves in valve-manifolds 14' and 14" are set as shown in FIG. 2. In the primary system, the refrigerant flows in the following loop path as indicated by the arrows: in liquid state under pressure from condenser 18' through high pressure line 20' to port D of valve-manifold 14', which is set to direct the liquid via source port A into the upper tube at the lower end of strip 12; in flowing through the evaporator tube, the liquid. state refrigerant evaporates and causes cooling. The resultant gas state refrigerant reaching valve-manifold 14", at the upper end of strip 12, is directed via tube port A, through the open top valve and via source port D into low pressure/suction line 22' which conducts the gas state refrigerant into compressor 24' where it is compressed and forced into condenser 18' for cooling and conversion back to liquid state to complete the cycle in the continuously recirculating loop process.

In this example, for illustrative purposes, the secondary source is a duplicate of the primary source, utilizing the middle tube in strip 12 as the evaporator, connected in the same manner and for the same refrigerant flow direction as in the primary system, reserving the third (bottom) tube as the backup.

The secondary system operates in the same manner as described above for the corresponding components in the primary system, with fluid flow in the following loop path as indicated by the arrows: in liquid state under pressure, from condenser 18" through high pressure line 20" and source port E of valve-manifold 14', through the open valve (fourth down from top) to tube port C, which is connected to the middle tube of strip 12, wherein gas at it its upper end enters valve-manifold 14" at tube port C, flowing through the open valve (fourth down), to source port E (valve-manifold 14"), via low pressure/suction line 22" to compressor 24" and back into condenser 18", reconverted to liquid state.

The dual sources could be made identical and utilized equally, e.g. time-shared alternately for designated equal time periods, with each serving as backup for the other. Optionally, the time-sharing could be made unequal, or the primary source could be utilized continuously, reserving the secondary source as the backup for emergency or unusual demand.

As another option, the secondary source could be made different from the primary source for a special type of standby system, for example one that would normally not run continuously or one that is designed for a different refrigerant or temperature range.

In addition to the dual-source system described above, the versatility provided by the triple-tube evaporator 10 and the valve-manifolds 14' and 14" of the present invention enables the configuration of numerous single-source arrangements including:

(a) A simple single-tube normal thermal operation of any kind wherein one of the three tubes is selected as the normal operating tube and the other two tubes are held in reserve as standby so that either of them stands ready to replace the normal operating tube in the event of a leakage failure.

(b) As in (a) but with two tubes selected for operation in parallel while the third tube is held in reserve as replacement standby in the event of a leakage failure in either of the other two operating tubes.

(c) All three tubes could be operated simultaneously in parallel by setting all six valves to the on (open) state.

While the illustrative embodiment is shown utilizing three tubes attached side-by-side in a row, and shaped so as to remain located generally in three flat planes corresponding to chamber walls, the invention could be practiced with more than three tubes, and/or they could be arranged other than in a row, for example in a multi-tube cluster of a radial array.

The exemplary configuration of valve-manifold 14 shown allows any one, two or all three of the tubes in strip 12 to be connected to the high and low pressure lines 20' and 24' of the primary source; optionally one or two tubes, if made available, could be redirected out of the main source and connected to an auxiliary source for purposes of backup cooling/refrigeration or for other special operations that may seek to introduce temperature variations, e.g. for accelerated cooling, heating or defrosting.

The redirecting and control principles described above can be extended to a network of refrigeration system elements including a plurality of evaporators/chambers and/or source (compressor/condenser) units, which can be co-located or remote and can be flexibly interlinked by additional master/slave valve-manifold units under centralized control.

The principle of the invention can be practiced in connection with practically any thermal exchanger and/or chamber regardless of intended operating temperature range, wherein fluid is circulated through tubing to absorb or dissipate heat and/or to develop and/or maintain a desired temperature in a thermal chamber, ranging from ultra-low freezers to warming/heating chambers.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A high reliability heat-exchange structure for a thermal chamber comprising:

multi-tube cluster including at least three adjacent parallel tubes configured from a continuous length of each tube formed in a grill-like array pattern of end-folded generally horizontal rows located in at least one plane approximating a wall location in the thermal chamber, each tube being made readily user-selectable for and capable of deployment in performance of a designated heat exchange process in the chamber, independent of the other tubes, involving flow-through of a fluid selected from a group including a liquid, a gas and a transitional combination thereof.

2. The high reliability heat-exchange structure as defined in claim 1 wherein each tube of the structure is made and arranged to be capable of operation as a refrigeration evaporator for refrigerating the chamber, independent of the other tubes, in consequence of flow-through of a refrigerant fluid supplied as input to the tube in pressurized liquid state, evaporating within the tube so as to create and maintain a lowered temperature in the chamber, and exiting the tube in a gaseous state.

3. The high reliability heat-exchange structure as defined in claim 1 wherein, in cross-sectional shape, the tubes in the multi-tube cluster are attached together side-by-side so as to form a flat multi-tube strip, and wherein each tube extends continuously from a first end of the multi-tube strip to a second end thereof.

4. The high reliability heat-exchange structure as defined in claim 3 wherein the multi-tube strip is shaped to form an array of adjacent rows disposed in at least one vertical plane parallel to a corresponding wall of the chamber and contained within a predetermined outline, each row being shaped at ends thereof to fold back in marginal regions of the outline in a manner to form the array of adjacent rows.

5. The high reliability thermal-exchange structure as defined in claim 3 further comprising:

a first valve-manifold comprising a plurality of tube ports, one for each tube in the multi-tube strip, located at the first end of the multi-tube strip, each tube port being connected in fluid communication with a first end of a corresponding tube;

a second valve-manifold comprising a plurality of tube ports, one for each tube in the multi-tube strip, located at the second end of the multi-tube strip, each tube port being connected in fluid communication with a second end of a corresponding tube;

said first and second valve-manifolds each comprising at least one source port and a plurality of on/off valves in a predetermined fluid communication pattern with the tube ports and the source port(s) such as to enable a designated selection of fluid communication links between the tube ports and the source port(s) via corresponding combinations of settings of the on/off valves.

6. The high reliability thermal-exchange structure as defined in claim 3 wherein the multi-tube strip comprises three parallel tubes.

7. The high reliability thermal-exchange structure as defined in claim 5 wherein:

said multi-tube strip comprises three parallel tubes; and, said first and second valve-manifolds each comprise three tube ports and two source ports.

8. The high reliability thermal-exchange structure as defined in claim 7 wherein said first and second valve-manifolds each further comprise six on-off valves arranged and connected to provide interruptable fluid communication between each of the three tube ports and each of the two source ports.

9. The high reliability thermal-exchange structure as defined in claim 2 wherein at least one of the tubes is connected in fluid communication with a refrigeration source including a condenser receiving refrigerant fluid from a compressor, a first end of the tube(s) being connected to the condenser via a high pressure line, and a second and opposite end of the tube(s) being connected to the compressor via a low pressure/suction line, so as to form in combination a refrigeration system with loop circulation capable of creating and maintaining a lowered temperature in the chamber.

10. The high reliability thermal-exchange structure as defined in claim 5 wherein said first and second valve-manifolds are connected in fluid communication with a refrigeration source including a condenser receiving refrigerant fluid from a compressor, the first valve-manifold receiving liquid refrigerant via a source port thereof through a high pressure line from the condenser, and the second valve-manifold receiving sending gaseous refrigerant via a source port thereof through a low pressure/suction line to the compressor, the on/off valves being set so as to operatively connect two opposite ends of a designated tube to the two source ports respectively, thus forming a refrigeration system with loop circulation capable of creating and maintaining a lowered temperature in the chamber due to evaporation in the tube.

* * * * *